US005667390A

United States Patent [19]

Keng

[11] Patent Number: 5,667,390

[45] Date of Patent: Sep. 16, 1997

[54] I/O CARD AND ITS ASSOCIATED CABLE HARNESS ASSEMBLY

[75] Inventor: Leon Keng, Taipei, Taiwan

[73] Assignee: Hon Hai Precision Ind. Co., Ltd., Taiwan

[21] Appl. No.: 398,427

[22] Filed: Mar. 6, 1995

[51] Int. Cl.[6] ..... H01R 9/09

[52] U.S. Cl. ..... 439/76.1; 439/449; 439/946

[58] Field of Search ..... 439/76.1, 77, 493, 439/946, 449, 465, 467, 610; 361/737

[56] References Cited

U.S. PATENT DOCUMENTS

| | | | |
|---|---|---|---|
| 3,951,492 | 4/1976 | Braund | 439/76.1 |
| 4,886,942 | 12/1989 | Lenz et al. | 439/493 |
| 5,061,845 | 10/1991 | Pinnavaia | 235/492 |
| 5,100,341 | 3/1992 | Czyz et al. | 439/447 |
| 5,207,586 | 5/1993 | MacGregor et al. | 439/76 |
| 5,242,310 | 9/1993 | Leung | 439/76 |
| 5,244,397 | 9/1993 | Anhalt | 439/101 |
| 5,313,364 | 5/1994 | Omori et al. | 361/737 |
| 5,330,360 | 7/1994 | Marsh et al. | 439/76 |
| 5,373,149 | 12/1994 | Rasmussen | 235/492 |
| 5,462,457 | 10/1995 | Schroepfer et al. | 439/447 |

FOREIGN PATENT DOCUMENTS

| | | | |
|---|---|---|---|
| 790046 | 12/1980 | U.S.S.R. | 439/493 |

*Primary Examiner*—Gary F. Paumen

[57] ABSTRACT

An I/O card and associated cable harness assembly (20) comprises an I/O card section (22) and a cable harness section (60) wherein the cable harness section (60) substantially structurally extends out of the I/O card section (22). The distal end of the cable harness section (60) is connected to an outside environment device (100). The cable harness section (60) has an engagement section (72) adapted to be latchably engaged within a cavity (32) in the I/O card section (22). There are a plurality of independent respective wires (64) extending within and along the cable harness section (60), and the front end of each wire (64) is appropriately solderably mounted to the corresponding pad on the internal PC board (26) in the I/O card section (22). The cable harness section (60) is substantially pre-assembled to the I/O card section (22) before the I/O card section (22) itself has been completely assembled. The I/O card section (22) associated with its integrally assembled cable harness section (60) is substantially structurally of one piece without any possibility of improper separation thereof, and that one piece assembly (20) may be substantially with the outside environment device (100) for transportation or sale due to the distal end of the cable harness section (60) directly attached to the outside environment device (100).

8 Claims, 5 Drawing Sheets

I/O CARD AND ITS ASSOCIATED CABLE HARNESS ASSEMBLY

BACKGROUND OF THE INVENTION

1. Field of the Invention

The invention relates to I/O cards and cable harness units for use therewith, particularly to the I/O card having a pro-assembled cable harness therein for being ready to connect a notebook computer and the corresponding periphery together.

2. The Prior Art

I/O cards are commonly used in the computer industry gradually. Different from the conventional IC memory card as shown in U.S. Pats. No. 5,061,845, 5,313,364 and 5,373,149 which has only one connection port, the typical I/O card as shown in U.S. Pat. Nos. 5,207,586, 5,242,310 and 5,244,397, has two connection ports at its two opposite ends wherein one is a connector as used in the aforementioned conventional IC memory card for engagement with a complementary connector installed in the computer case, and the other is an I/O connector adapted to be engaged with a cable harness unit which may directly extend from or is attached to a specific periphery such as a modem or a multi-media device. Through its internal circuits, the I/O card can function as an interface between such a peripheral and the notebook computer for achieving the specific performance.

As well known, the end user himself often needs to set up the whole function system after he buys a basic computer set and in a later time he further wants to perform some additional functions by connecting the corresponding peripheral or outside environment thereto. In this situation, the user can buy such a outside environment, and a corresponding I/O card which is substantially an interface between the outside environment and the computer set. Moreover, if the outside environment of a type has no associated connection cable projecting therefrom for directly coupling to the corresponding I/O card, it is necessary for the user to buy additional cable harness for connecting the I/O card to the outside environment. As shown in FIG. 1 which is substantially a main figure of U.S. Pat. No. 5,330,360, an I/O connector 10 embedded within a I/O card 12, is adapted to be designedly engaged with a complementary connector 14 of a cable harness 16 which is connected to an outside environment. As experienced, because of the tiny dimensions of the I/O connector 10 of the I/O card 12 and of the complementary connector 14 of the cable harness 16, the manufacturing cost thereof is relatively high and substantially of a high percentage of the cost of the whole I/O card set or the cable harness set.

From a viewpoint of manufacturing, to lower the cost of this assembly, i.e., the I/O card and the corresponding cable harness, it may eliminate the costly I/O connector in the I/O card and its complementary connector of the cable harness. Unfortunately, because the manufacturers of the outside environment and of the I/O card are different and separate, till now there is no such a subject discussed or efforts taken to efficiently achieve the goal of cost-down.

Accordingly, an object of the invention is to provide an I/O card associated with a cable harness which substantially extends integral with the I/O card. In comparison with the conventional coupling of the I/O card and the corresponding cable harness, the invention eliminates an I/O connector originally positioned in the I/O card and a complementary connector of the cable harness, thus significantly reducing the cost thereof for economic consideration.

Additionally, from a viewpoint of engineering, in the conventional engagement between the I/O card and the complementary cable harness includes two corresponding connectors (10, 14) which results in increasing of contact resistance and may induce improper intermittence thereof. Therefore, another object of the invention is to provide an I/O card with an associated cable harness assembly having an expected better technical performance and reliability.

Moreover, from a viewpoint of application of the end user, it is unnecessary to buy a scanner or modem and a separate independent I/O card such as a scanner card or a modem card which only designedly couples to the specific device (scanner or modem) in the real operative application. There is also no need for the user to connect or disconnect such two components (i.e., the I/O card and the outside environment device) repeatedly under the condition that such a I/O card is substantially only designed to cooperate with such a specific device in operation. Thus, another object of the invention is to provide an I/O card and cable harness assembly without requirements or possibility of the connection/disconnection issue therebetween for easy operation, and the specific I/O card and associated cable harness even is substantially of a part of the specific corresponding device in selling or transporting to simplify, for the end user, the installation of the corresponding periphery regard to the computer set for desired functions.

SUMMARY OF THE INVENTION

According to an aspect of the invention, an I/O card associated with a cable harness which substantially extends from the I/O card. The distal end of the cable harness is connected to an outside environment. The cable harness has an engagement section adapted to be latchably engaged within a cavity in the I/O card. The are a plurality of independent respective wires extending within and along the cable harness and the front end of each wire is appropriately solderably mounted to the corresponding pad on the internal PC board in the I/O card. The cable harness is substantially pre-assembled to the I/O card before the I/O card itself has been completely assembled. The I/O card associated with its integrally assembled cable harness is substantially structurally of one piece without any possibility of separation thereof, and that one piece assembly may be substantially with the outside environment for sale due to the distal end of the cable harness directly attached to the outside environment.

DETAILED DESCRIPTION OF THE PREFERRED EMBODIMENTS

References will now be made in detail to the preferred embodiments of the invention. While the present invention has been described with reference to the specific embodiments, the description is illustrative of the invention and is not to be construed as limiting the invention. Various modifications to the present invention can be made to the preferred embodiments by those skilled in the art without departing from the true spirit and scope of the invention as defined by appended claims.

Figure 2:
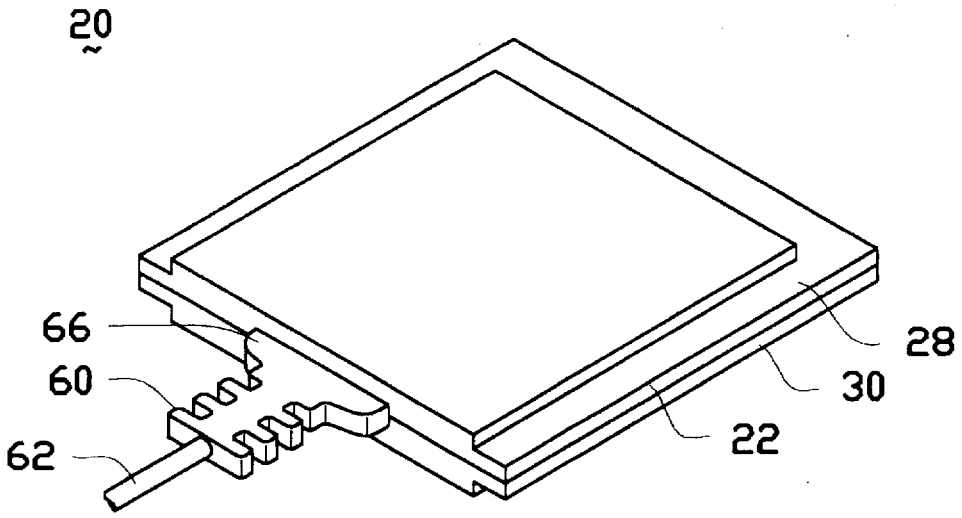
FIG. 2 is a fragmentary perspective view of a first embodiment of an I/O card with its associated cable harness assembly according to the invention.
Figure 4:
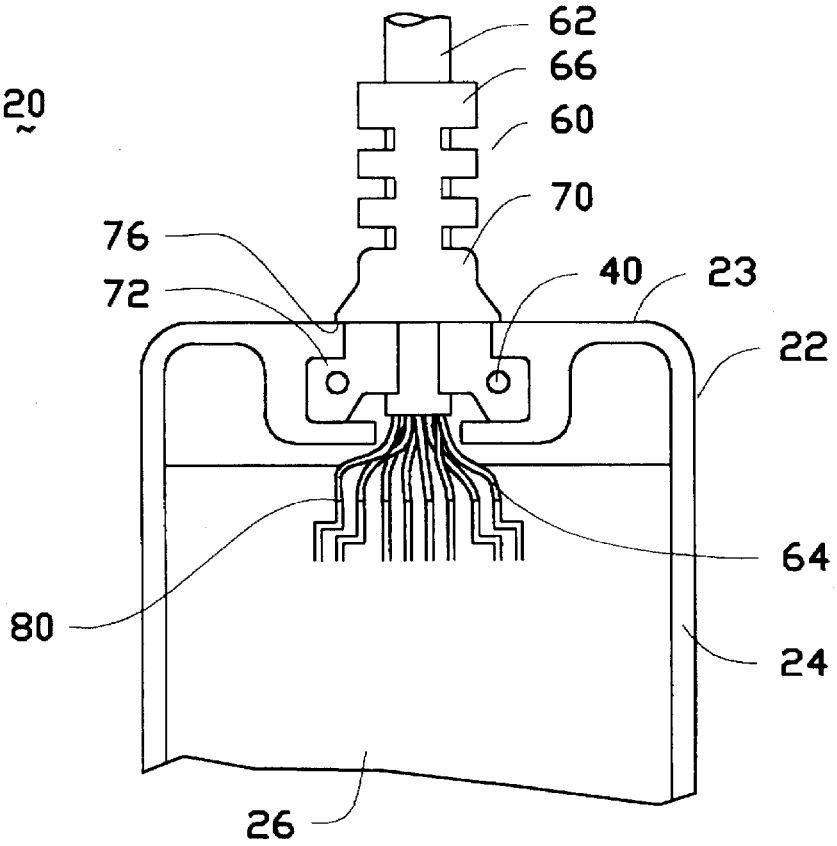
FIG. 4 is a fragmentary cut-away top view of the I/O card with associated cable harness assembly of FIG. 2.
Figure 3:
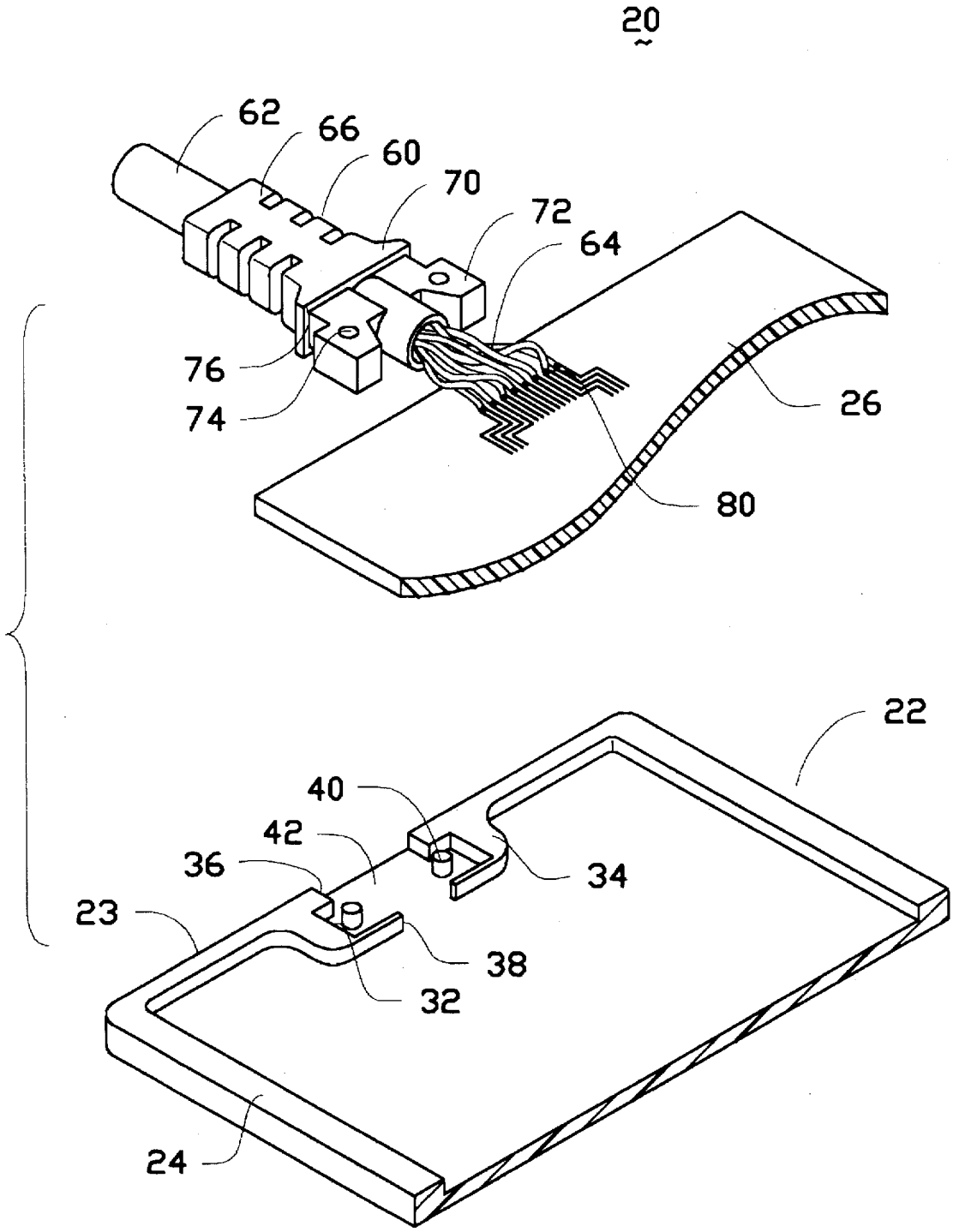
FIG. 3 is a fragmentary cut-away exploded perspective view of the I/O card with associated cable harness assembly of FIG. 2 without the top cover and the lower bottom cover to show the inner structure thereof.

It will be noted here that for a better understanding, most of like components are designated by like reference numerals throughout the various figures in the embodiments. Attention is now directed to FIGS. 2, 3 and 4 wherein an assembly 20 includes an I/O card section 22 and a cable harness section 60. The I/O card section 22 comprises a frame 24 supportably holding a PC board 26 thereon. FIG. 2 shows a top cover 28 and a bottom cover 30 for sandwiching the frame 24 therein and protectively embedding the internal PC board 26 therein. An opening (not shown) is formed in the assembled top cover 28 and the bottom cover 30 for allowing passage of the cable harness section 60 therethrough.

The PC board 26 includes a plurality of electrical components (not shown) such as chips disposed on the surface for performance of specific functions. It can be understood that the PC board 26 is adhesively attached inside the frame 24, and the upper and bottom covers 28, 30 are adhesively attached outside the frame 24. The frame 26 further includes a cavity 32 defined by a rectangular bar portion 34 having a front slot 36 and a rear slot 38 for allowing passage of the corresponding cable harness section 60 to extend therethrough in a front-to-end direction. A pair of aligning posts 40 extend upward from the supporting plane 42 of the frame 24 and into the cavity 32 for cooperative engagement with the cable harness section 60.

The cable harness section 60 has generally a large round cable jacket portion 62 having a braided shield (not shown) lying within the jacket portion 62 for enclosing a plurality of small wires 64 therein. One end of the cable harness section 60 is electrically and mechanically received within a specific device 100 (FIG. 6), and the other end of the cable harness section 60 includes an expansion portion 66 having a series of reinforcement ring sectors 68, a abutting block 70, and a pair of pier-like projections 72. Each pier-like projection 72 has a hole 74 extending vertically therethrough for receipt of the corresponding post 40 on the frame 24. The plurality of wires 64 respectively extends outwardly from the jacket portion 62 and spread laterally for respective solderable attachment onto the PC board 26.

Figure 6:
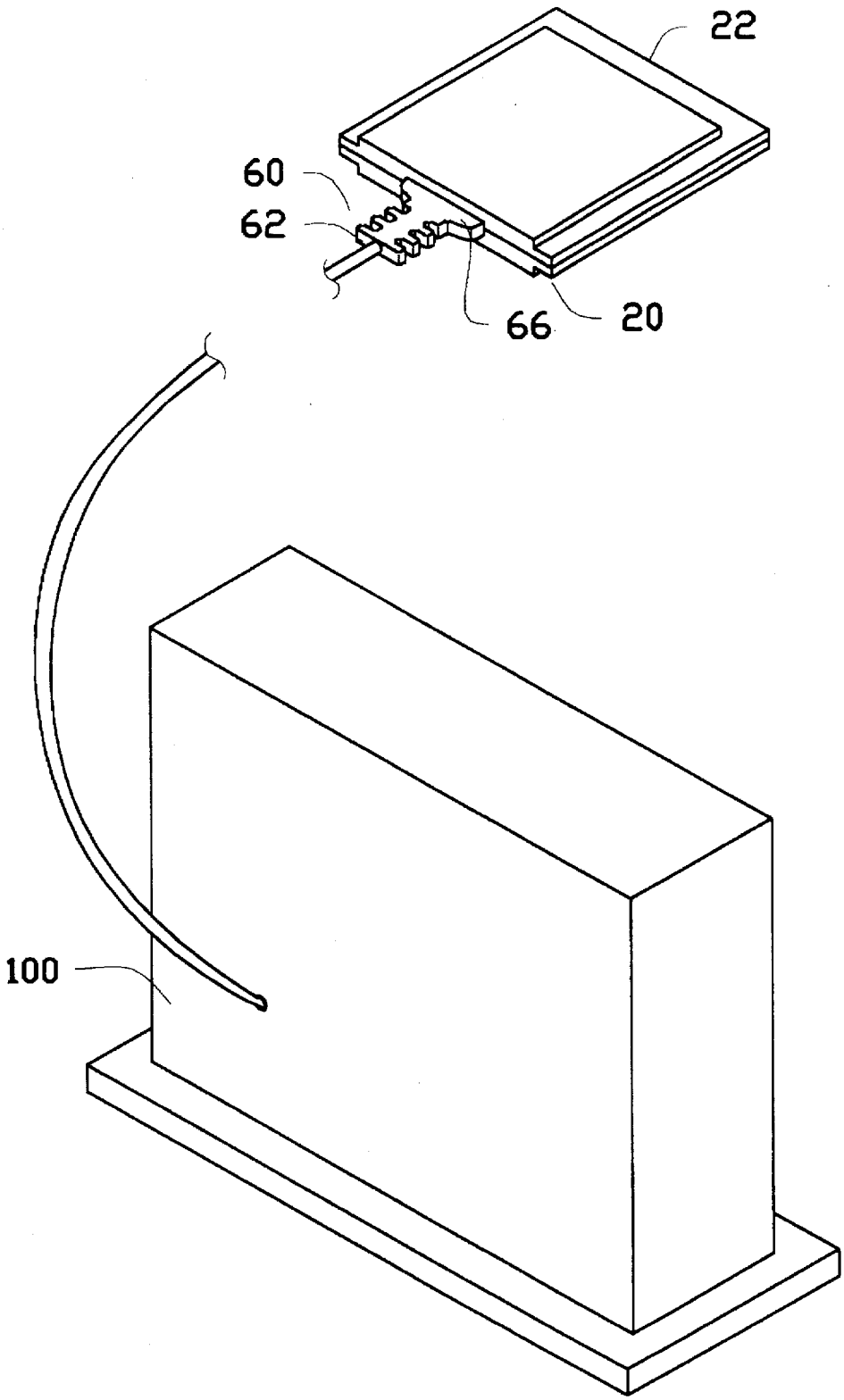
FIG. 6 is a perspective view of the I/O card with associated cable harness assembly of FIG. 2 and that substantially integrally extends from the outside environment device for easy set-up for the end user.

When assembled (see FIG. 4), the pier-like projections 72 of the cable harness section 60 are moved to the frame 24 from the top and successively tightly embedded within the cavity 32 in the frame 24 wherein the posts 40 on the frame 24 are snugly received in the holes 74 respectively for alignment. The front slot 36 of the frame 24 allows the other portions of the cable harness section 60 to extend outwardly from the frame 24, and the rear slot 38 allows the plural wires 64 to extend from the cavity 32 to the PC board 26 and be successively soldered on the corresponding circuit traces printed on the PC board 26 for electrical connection. In this situation, the front surface 76 of the abutting block 70 generally confronts the edge surface 23 of the frame 24. The pier-like projections 72 tightly embedded within the cavity 32 function as strain relief means for transferring the forces applied to the exterior jacket portion 62 of cable harness section 60, to the frame 24 of the I/O card section 22 without jeopardizing the solder joints 80 of the exposed tips of the wires and the corresponding circuit traces on the PC board 26. Lastly, the top cover 28 and the bottom cover 30 are respectively adhesively attached to the opposite top side and bottom side of the frame 24. It is appreciated that the pier-like projections 72 are tightly sandwiched between the top cover 28 and the supporting plane 42 of the frame 24. As shown in FIG. 6, in this embodiment the distal end of the jacket porion 62 of the cable harness section 60 is fixedly positioned within the device 100, the assembled I/O card and associated cable harness assembly 20 is substantially an integral portion of device 100 for transportation or sale. Understandably, in other embodiments, such a distal end of the jacket portion 62 may be attached to the device 100 through a set of connector.

General speaking, in this embodiment of the present invention, an I/O connector of the I/O card and a complementary connector of the cable harness are removed, thus significantly reducing the cost of the whole set of the final assembly of the I/O card and the corresponding cable harness. The complication of the complementary connector of the cable harness for mating with the I/O connector in the I/O card, can be referred to U.S. Pat. No. 5,364,292. The invention eliminates the conventional I/O connector in the I/O card and the complementary connector of the cable harness can financially reduce the manufacturing cost, and technically reduce the contact resistance and possibility of intermittence.

Figure 5:
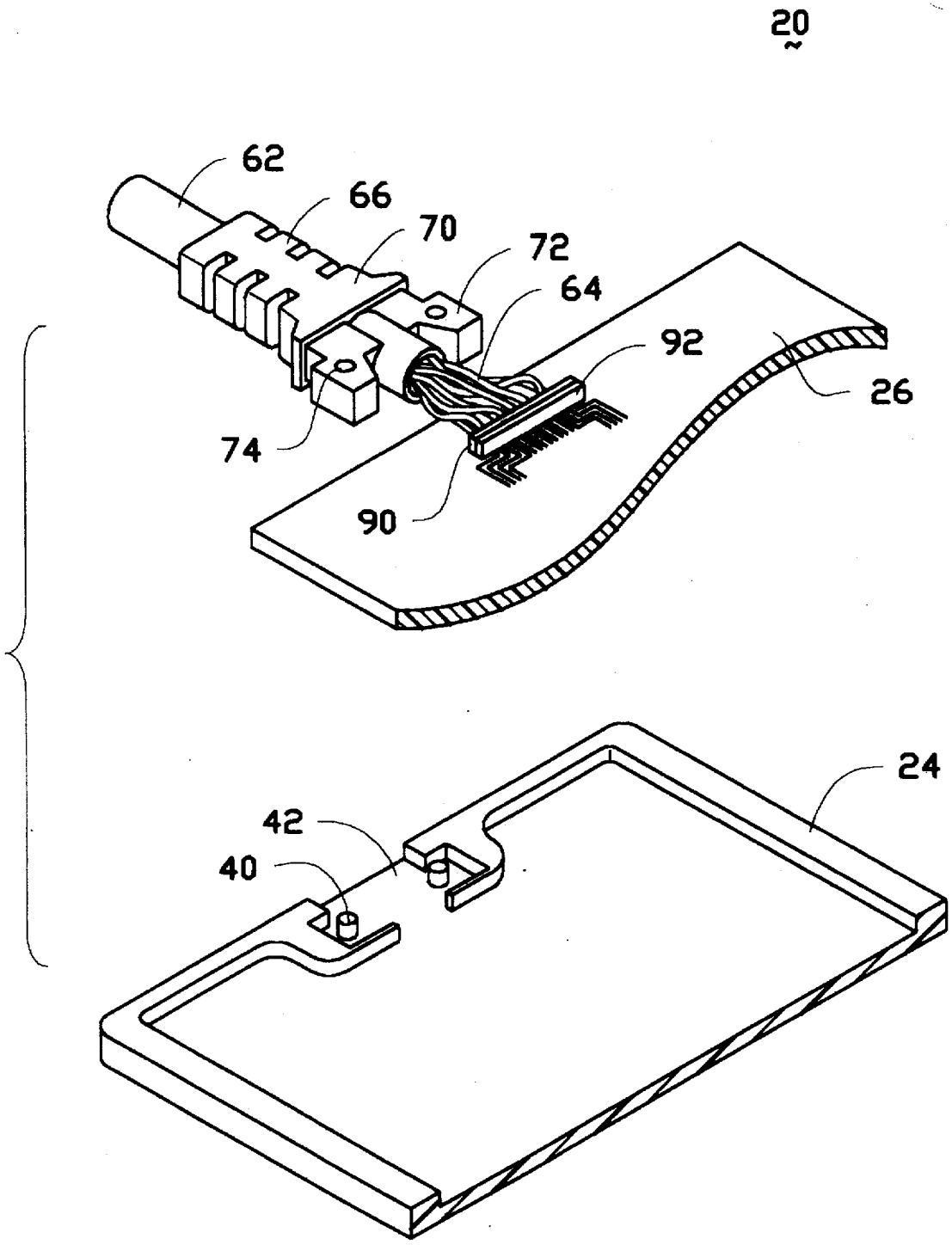
FIG. 5 is a fragmentary cut-away exploded perspective view of a second embodiment of an I/O card with associated cable harness assembly without covers thereof, according to the invention.

FIG. 5 shows another embodiment of the invention wherein the exposed tips of the wires 64 is soldered onto the first connector 90, and the traces on the PC bard 26 are electrically engaged with the second connector 92, so that such wires 64 can electrically communicate with traces on the PC board through such a pair of connectors 90, 92. In this embodiment, the top cover 28 and the bottom cover 30 can be fixed to the frame 24 by snap-in attachment. Because the wires 64 are not directly soldered on the PC board 26, the cable harness section 60 can be removed from the I/O card section 22 by disassembling the whole I/O card and cable harness assembly. In other words, the I/O card section 22 can be coupled to the new cable harness section 60 by replacing the damaged old one (cable harness section 60). Therefore, in comparison with the first embodiment, the second embodiment allows only changing the damaged cable harness section 60 in place of abandoning the whole set of assembly of the first embodiment if there is a damage occurring to the cable harness section 60. Accordingly, the design of the second embodiment has some potential advantage for repairing or replacement.

Figure 1:
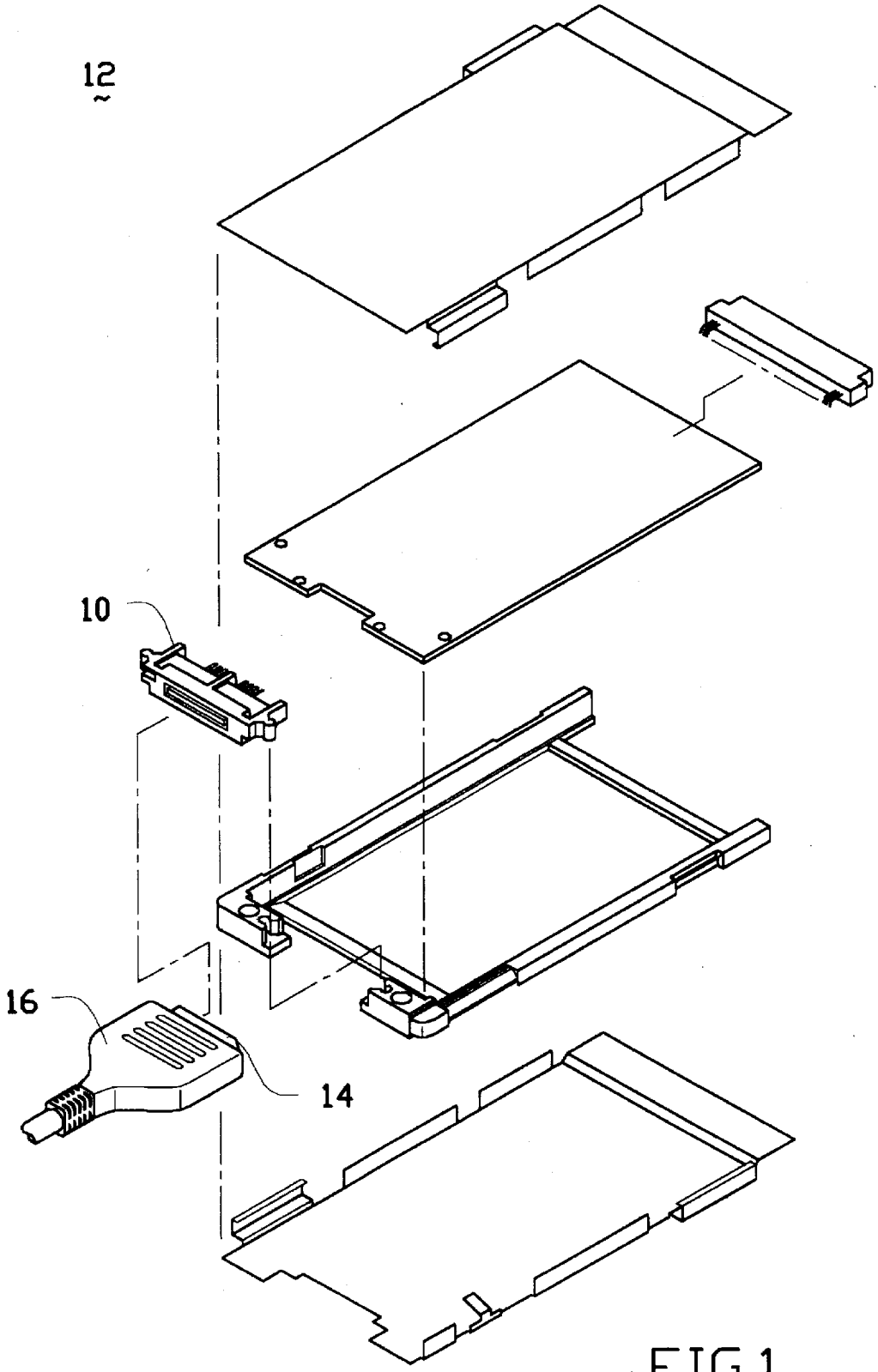
FIG.1 (PRIOR ART)
FIG. 1 is a perspective view of a conventional I/O card and the complementary cable harness.

In this second embodiment of FIG. 5, even though the wires 64 are not directly solderably engaged with the traces on the PC board, but through a pair of connectors 90, 92, the embodiment of the invention still is superior to the prior art. It can be noted that different from the prior art assembly, in the second embodiment of the invention, the strain relief means (72) of the cable harness section 60 is substantially spaced from the wire connection area with the connector 90, thus assuring a reliable electrical transmission therebetween. Differently, as shown in FIG. 1, the conventional prior art cable requires to have a strong and proper strain relief portion to enclosing the complementary connector 14 therein for engagement with the corresponding I/O connector 10, and thus complicating the manufacturing process and increasing the cost as shown in aforementioned U.S. Pat. No. 5,364,292. Secondly, because the set of connectors 90, 92 is substantially positioned within the I/O card section 22, it is provided with a desired shielding for EMI (Electro-Magnetic Interference) by the metallic top and bottom covers 28, 30. Differently, as shown in FIG. 1, the prior art cable harness generally lacks proper shield on its connector end (14), or the complementary connector may be covered by the metal shield additionally. The former is definitely short of complete shielding for EMI, and the latter will increasing the material cost and complicating the manufacturing process. Therefore, the second embodiment of the invention is deemed beneficial from a viewpoint of engineering.

While the present invention has been described with reference to specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims.

What is claimed is:

1. An I/O card and associated cable harness assembly comprising:

an I/O card section and a cable harness section;

said I/O card section including a frame snadwiched between a top cover and a bottom cover;

an internal PC board positioned in said I/O card section;

said cable harness section including a jacket portion enclosing a plurality of wires therein;

a strain relief means of said cable harness section cooperatively retained within the I/O card section for assembling said I/O card section and said cable harness section together as one unit for transportation or sale; wherein the frame of said I/O card section includes a cavity for snug receipt of said strain relief means of said cable harness section, and said strain relief means comprises a pair of pier-like projections for compliance with a configuration of said cavity in the frame, and each of the pier-like projections further includes a hole to receive a corresponding post extending upward within the cavity.

2. The assembly as described in claim 1, wherein the frame further includes a front slot and a rear slot communicating with the cavity, the cable harness section extending out of the I/O card section and communicating with an interior of the I/O card section where the PC is located.

3. The assembly as described in claim 1, wherein said plurality of wires are directly solderably mounted onto a plurality of circuit traces on the PC board.

4. The assembly as described in claim 3, wherein said plurality of wires extend through the rear slot of the frame to reach the corresponding circuit traces on the PC board.

5. A unitary assembly comprising an I/O card and a cable harness extending from said I/O card;

said I/O card including a frame shielded by cover means;

an internal PC board supportably held within an interior of said I/O card;

said cable harness comprising a plurality of wires wherein a front end of each of said wires substantially extends into the interior of said I/O card for electrical communication with a corresponding circuit on said PC board, and wherein the cable harness is substantially pre-assembled to the I/O card before said I/O card itself Has been completely assembled, and wherein said cable harness includes a strain relief means which is snugly received within a cavity in the I/O card and confronts a front slot of the I/O card which has a reduced width for only allowing portions of the cable harness to extend therethrough but confining the strain relief means within the cavity.

6. The assembly as described in claim 5, wherein said first end of each wire is directly mounted onto a circuit trace on said PC board without any redundant connectors.

7. An I/O card and associated cable harness assembly comprising:

an I/O card section and a cable harness section;

said I/O card section including a frame sandwiched between a top cover and a bottom cover;

an internal PC board positioned in said I/O card section;

said cable harness section including a jacket portion enclosing a plurality of wires therein;

a strain relief means of said cable harness section cooperatively retained within the I/O card section for assembling said I/O card section and said cable harness section together as one unit for transportation or sale; wherein the frame of said I/O card section includes a cavity for snug receipt of said strain relief means of said cable harness section, and the frame further includes a front slot and a rear slot communicating with the cavity, the cable harness section extending out of the I/O card section through the rear slot and communicating with an interior of the I/O card section where the PC board is located.

8. An I/O card and associated cable harness assembly comprising:

an I/O card section and a cable harness section;

said I/O card section including a frame sandwiched between a top cover and a bottom cover;

an internal PC board positioned in said I/O card section;

said cable harness section including a jacket portion enclosing a plurality of wires therein;

a strain relief means of said cable harness section cooperatively retained within the I/O card section for assembling said I/O card section and said cable harness section together as one unit for transportation or sale; wherein said a plurality of wires are directly soldered onto a plurality of circuit traces on the PC board, and said plurality of wires extend through the rear slot of the frame to reach the corresponding circuit traces on the PC board.

* * * * *